US008659380B2

(12) United States Patent
Andersson et al.

(10) Patent No.: US 8,659,380 B2
(45) Date of Patent: Feb. 25, 2014

(54) REACTOR SHIELD

(75) Inventors: Lars-Tommy Andersson, Ludvika (SE); Anders K. Peterson, Ludvika (SE)

(73) Assignee: ABB Technology Ltd., Zürich (CH)

( * ) Notice: Subject to any disclaimer, the term of this patent is extended or adjusted under 35 U.S.C. 154(b) by 684 days.

(21) Appl. No.: 12/301,560

(22) PCT Filed: May 19, 2006

(86) PCT No.: PCT/SE2006/000588

§ 371 (c)(1),
(2), (4) Date: Mar. 17, 2009

(87) PCT Pub. No.: WO2007/136307

PCT Pub. Date: Nov. 29, 2007

(65) Prior Publication Data

US 2009/0206976 A1 Aug. 20, 2009

(51) Int. Cl.

| | |
|---|---|
| ***H01F 27/36*** | (2006.01) |
| ***H01F 38/30*** | (2006.01) |
| ***H01F 27/32*** | (2006.01) |
| ***H01F 7/06*** | (2006.01) |

(52) U.S. Cl.
USPC ..... 336/84 C; 336/84 R; 336/84 M; 29/602.1

(58) Field of Classification Search
USPC ..... 336/84 R, 84 C, 84 M; 29/602.1
See application file for complete search history.

(56) References Cited

U.S. PATENT DOCUMENTS

| | | | | | |
|---|---|---|---|---|---|
| 3,195,087 | A | * | 7/1965 | Welch | 336/84 R |
| 3,671,902 | A | * | 6/1972 | Westendorp | 336/84 R |
| 3,717,833 | A | * | 2/1973 | Kubota et al. | 336/69 |
| 6,054,854 | A | * | 4/2000 | Kawamoto | 324/318 |
| 6,239,681 | B1 | * | 5/2001 | Buswell | 336/83 |

FOREIGN PATENT DOCUMENTS

| | | | | |
|---|---|---|---|---|
| CH | 230974 | A | | 5/1944 |
| GB | 1220151 | A | | 1/1971 |
| JP | 59172709 | A | * | 9/1984 |
| JP | 05347152 | A | * | 12/1993 |

OTHER PUBLICATIONS

JP 06-009047 U, Feb. 4, 1994.*
PCT/ISA/210—International Search Report—Jan. 11, 2007.
PCT/IPEA/409—International Preliminary Report on Patentability—May 6, 2008.
PCT/ISA/237—Written Opinion of the International Searching Authority—Jan. 11, 2007.

* cited by examiner

*Primary Examiner* — Tsz Chan
(74) *Attorney, Agent, or Firm* — Venable LLP; Eric J. Franklin

(57) ABSTRACT

A reactor shield including a plurality of closed loops of electrically conductive wires arranged around a reactor.

7 Claims, 5 Drawing Sheets

REACTOR SHIELD

CROSS-REFERENCE TO RELATED APPLICATIONS

This application is the national phase under 35 U.S.C. §371 of PCT/SE2006/000588 filed 19 May 2006.

FIELD OF INVENTION

The present invention relates to a reactor shield for high voltage reactors, such as for reactors used with HVDC systems.

BACKGROUND

In many power applications, such as in HVDC systems, a DC reactor is connected in series with a converter to reduce the harmonic currents on the DC or AC side of the converter or to reduce the risk of commutation failures by limiting the rate of rise of the DC line current at transient disturbances in the AC or DC systems. The converter reactor is surrounded by a shield to avoid inductive heating of the walls of the building in which the reactor is provided and to decrease the magnetic coupling between the three phases. The shields may also contribute to the RI shielding.

Different kinds of shield designs have been used. One example is solid aluminium plates. However, this solution has the drawback of the risk for sound emission. Another drawback is difficult construction on site due to welding operations when the plates are joined to surround the reactor.

Some prior art solutions involve water cooling of the shield. However, this leads to an expensive and complex arrangement.

SUMMARY OF THE INVENTION

An object of the present invention is to provide a reactor shield which is easy to assemble on site and which is flexible as regards the configuration.

The invention is based on the realization that the prior art plates can be replaced by electrically conductive wires which form a number of closed loops about the reactor so as to form a shield.

According to the invention there is provided a reactor shield comprising an electrically conductive material arranged to be provided around a reactor, which is characterised in that the electrically conductive material comprises a plurality of closed loops of electrically conductive wires.

Thus there is provided a reactor shield which is easy to assemble on site and which is flexible as regards the configuration

BRIEF DESCRIPTION OF DRAWINGS

The invention is now described, by way of example, with reference to the accompanying drawings, in which.

DETAILED DESCRIPTION OF PREFERRED EMBODIMENTS

In the following a detailed description of a preferred embodiment of the present invention will be given.

Figure 1:
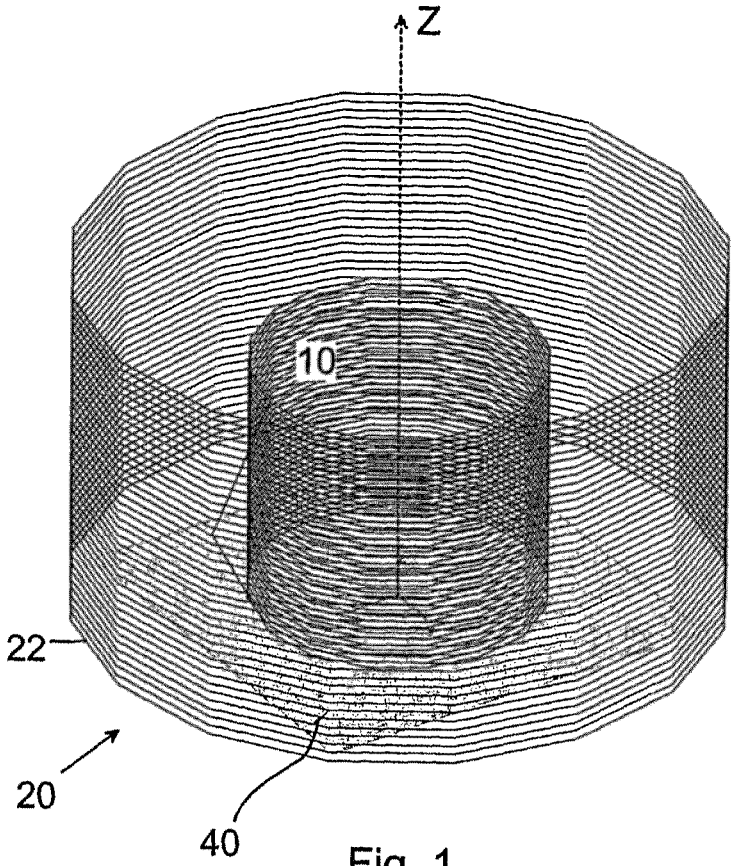
FIG. 1 is a schematic overview of a reactor and a reactor shield according to the invention.

In FIG. 1 there is shown a schematic overview of a reactor 10 provided inside a reactor shield 20. The reactor 10 could be any kind of reactor, such as a reactor provided in a HVDC system mentioned above, emitting electro-magnetic radiation. The reactor shield comprises a number of closed circular loops of electrically conductive wires 22 provided in mutually parallel horizontal planes. The wire loops and the reactor are provided co-axially about a vertical axis z, thereby providing for a uniform distance between the reactor and the reactor shield formed by the loops.

The wires are preferably twisted stranded wires made of copper or aluminium. The designs with stranded wire are favorable since the area per length unit is relatively large, reducing the skin effects that might appear. A twisted, stranded wire is expected to redistribute the current. Furthermore, the loops can be prefabricated from standard material, and only have to be mounted on site. They are also flexible in that wires can easily be added, redistributed or replaced by thicker ones if e.g. an upgrading to a higher reactor current is wanted. Furthermore, problems with sound emission are not expected.

An electrically conductive aluminium plate 40 with a thickness of 3 millimeters is optionally provided inside the closed loops in a position between the reactor 10 and the floor so as to prevent electromagnetic radiation from penetrating the floor, thereby generating heat in electrically conductive reinforcement in the floor.

Figure 2:
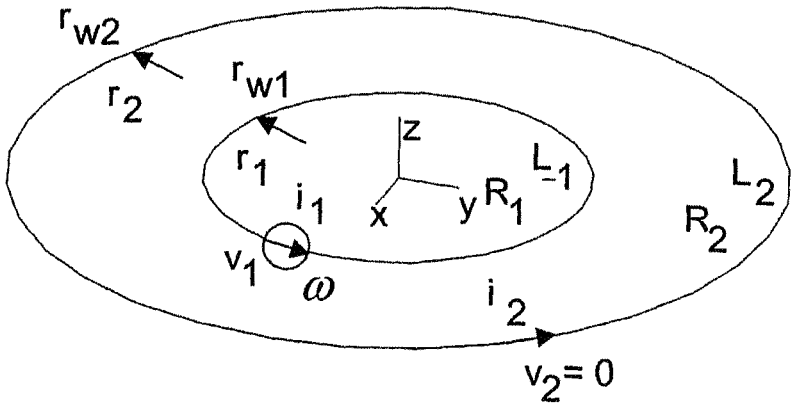
FIG. 2 shows a theoretical model explaining the inventive idea.

To gain some physical understanding of the shielding mechanism and the influence of various parameters, a simple model of the reactor 10 and the reactor shield 20 is shown in FIG. 2. An inner loop, corresponding to the reactor 10, with self-inductance $L_1$ and resistance $R_1$ is connected to a constant current source with current $i_1$ and angular frequency $\omega$, resulting in a voltage $v_1$. In an outer, short-circuited loop, corresponding to one of the closed wire loops 22 of the shield 20, with self-inductance $L_2$ and resistance $R_2$, a current $i_2$ will be induced which counteracts the magnetic field from the inner loop due to the mutual inductance M.

The following equations apply:

$$v_1 = R_1 i_1 + \frac{d\phi_1}{dt} + \frac{d\phi_{21}}{dt} \tag{1}$$

$$0 = v_2 = R_2 i_2 + \frac{d\phi_2}{dt} + \frac{d\phi_{12}}{dt} \tag{2}$$

where the partial magnetic fluxes $\phi_1=L_1 i_1$ and $\phi_{21}=M_{21} i_2$, etc. Since the mutual inductance $M_{21}=M_{12}$, M can be used instead.

If $R_2=0$ it is clear that the total flux through the outer loop cannot change with time; if it was zero to start with, then it must remain zero. This means that the total return flux outside the outer loop must be zero as well. However, this does not imply that the local magnetic field is zero everywhere.

Switching to complex notation and assuming that $i_1=I_1e^{j\omega t}$, (1) and (2) give $$V_i=R_1I_1+j\omega L_1I_1+j\omega MI_2 \quad (3)$$

$$0=R_2I_2+j\omega L_2I_2+j\omega MI_1 \quad (4)$$

Equation (4) gives $$I_2=-\frac{j\omega MI_1}{R_2+j\omega L_2} \quad (5)$$

$$\left(=-\frac{M}{L_2}I_1 \text{ if } R_2 \text{ can be neglected}\right)$$

whereafter (3) gives $$V_1=R_1I_1+j\omega L_1I_1+j\omega M\left(-\frac{j\omega MI_1}{R_2+j\omega L_2}\right) \quad (6)$$

If $R_2$ can be neglected, (6) gives a simple expression for the effective inductance of the two loops as seen from the current source $i_1$:

$$L_{eff}=L_1-\frac{M^2}{L_2} \quad (7)$$

The power dissipation in the outer loop can be expressed as $$P=R_2I_2I_2^*=\frac{R_2}{R_2^2+\omega^2L_2^2}\omega^2M^2I_1^2 \quad (8)$$

where $\omega MI_1$, is the electromotive force in the outer loop induced by the constant current in the inner loop. The power dissipation obviously has a maximum for $R_2=L_2$-Equation (8) can be used to study how the power dissipation varies when the parameters (including the geometry) are changed, but first the dependences of the resistance, the self inductance and the mutual inductance on the geometry must be known.

The resistance is simple, but the skin effect can be a complication. By using stranded wires, the skin effect is reduced as has been explained above.

The self inductance is rather straight-forward for a circular loop:

$$L_2=\mu_0r_2\left(\frac{\mu}{4}+\ln\frac{8r_2}{r_{w2}}-2\right) \quad (9)$$

where $r_2$ is the loop radius, $r_{w2}$ the wire radius and $\mu$ the relative permeability for the outer loop ($\mu$=1 for aluminium). The skin effect can be a complication also here if the internal inductance, i.e., the first term between the parentheses, cannot be neglected.

The mutual inductance between two circular loops is more complicated since the analytical expression contains elliptic integrals. A more practical way is to use tables and simple expressions from the handbook literature. Simplified, for two concentric loops in the same plane the following equation apply.

$$M=\mu\sqrt{r_1r_2}\cdot F(M \text{ in } \mu\text{H}, r_1 \text{ and } r_2 \text{ in cm}) \quad (10)$$

where F is a function of r1 and r2.

The current and thus the heat dissipation can be decreased considerably by a moderate increase of the shield radius. This is due to a decreased mutual inductance combined with higher self-inductance and resistance (equation 5).

The conductivity of the loops may vary for several reasons, such as wire material and temperature.

Figure 3:
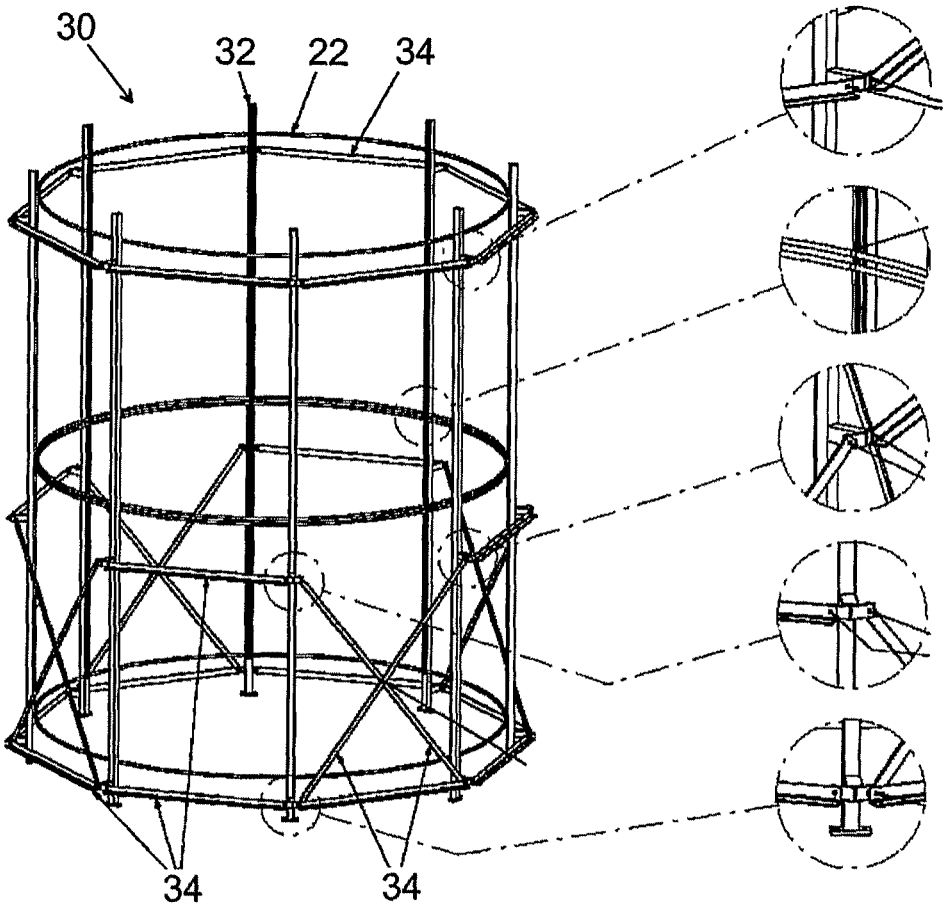
FIG. 3 is a perspective overview of the frame of a reactor shield according to the invention.

Referring to FIG. 3, the wire loops 22 are held in fixed mutual relationship by means of a frame 30, which is made up of eight equidistant vertical poles 32 of suitable dimensions and material, such as aluminium. Cross bars 34 are provided between the vertical poles 32 and attached thereto by means of e.g., stainless steel bolts so as to provide a stable frame to which the wire loops can be attached.

Figure 4:
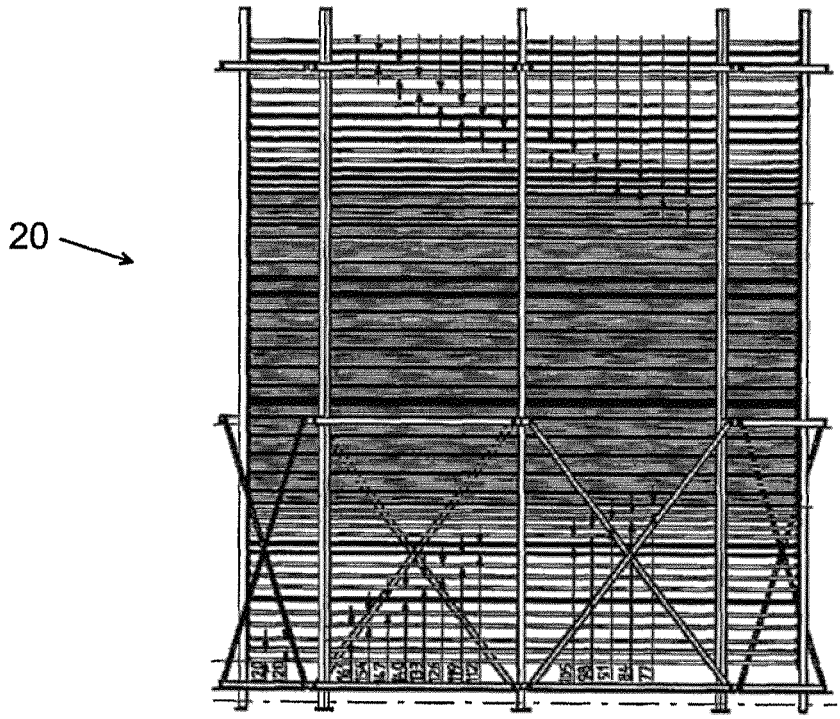
FIG. 4 is a side view of a reactor shield according to the invention.

FIG. 4 shows a side view of the reactor shield 20 including the frame 30 and a number of wire loops 22 attached to the frame. It is here seen that the wire loops are unevenly distributed in a vertical direction, with a higher distribution density towards a vertical mirror line halfway up the reactor shield. This distribution density of wires is correlated to the density of the magnetic field. The purpose is to achieve well distributed losses in the shielding, thereby optimizing the use of material.

Figure 5:
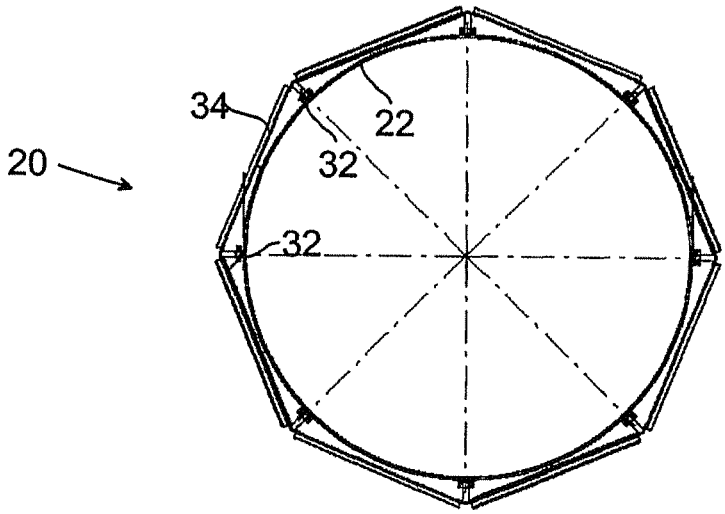
FIG. 5 is a top view of the reactor shield shown in FIG. 4.

FIG. 5 shows a top view of the reactor shield 20 shown in FIG. 4. It is here seen that the wire loops 22 are attached to the inside of the vertical poles 32. This is preferably effected by means of T-bolts of stainless steel.

Figure 6:
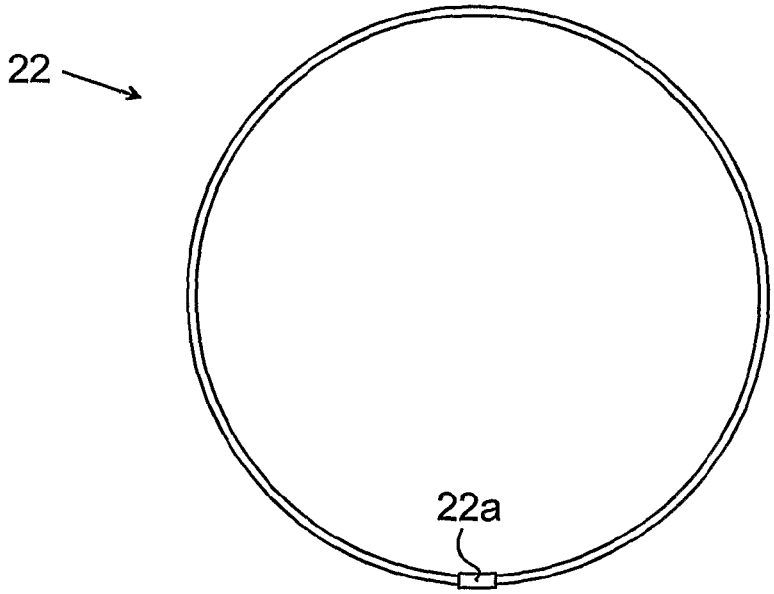
FIG. 6 is a top view of a wire loop comprised in a reactor according to the invention.

A wire loop 22 is shown in detail in FIG. 6. A wire having a length, which is given by the desired radius, is joined together at it ends by means of a jointing sleeve 22*a*. The operation of attaching the jointing sleeve can be performed on-site. This has the advantage of requiring less transport space for the wire. Alternatively, the wire loop 22 can be delivered to the site ready for mounting, but this requires more transport space.

A preferred wire loop distribution will now be described with reference to FIG. 7, wherein the cylindrical geometry is shown with the vertical z axis to the left. Z=0 is a symmetry plane, about which the distribution of the windings is mirrored. In this figure, the reactor 10, having a radius r1 of approximately 1.5 meters, is shown as a rectangle. The reactor shield 20 is shown with a radius r2 of 3.0 meters. The denser distribution close to the symmetry plane z=0 is due to the larger field from the reactor at that point.

Figure 7:
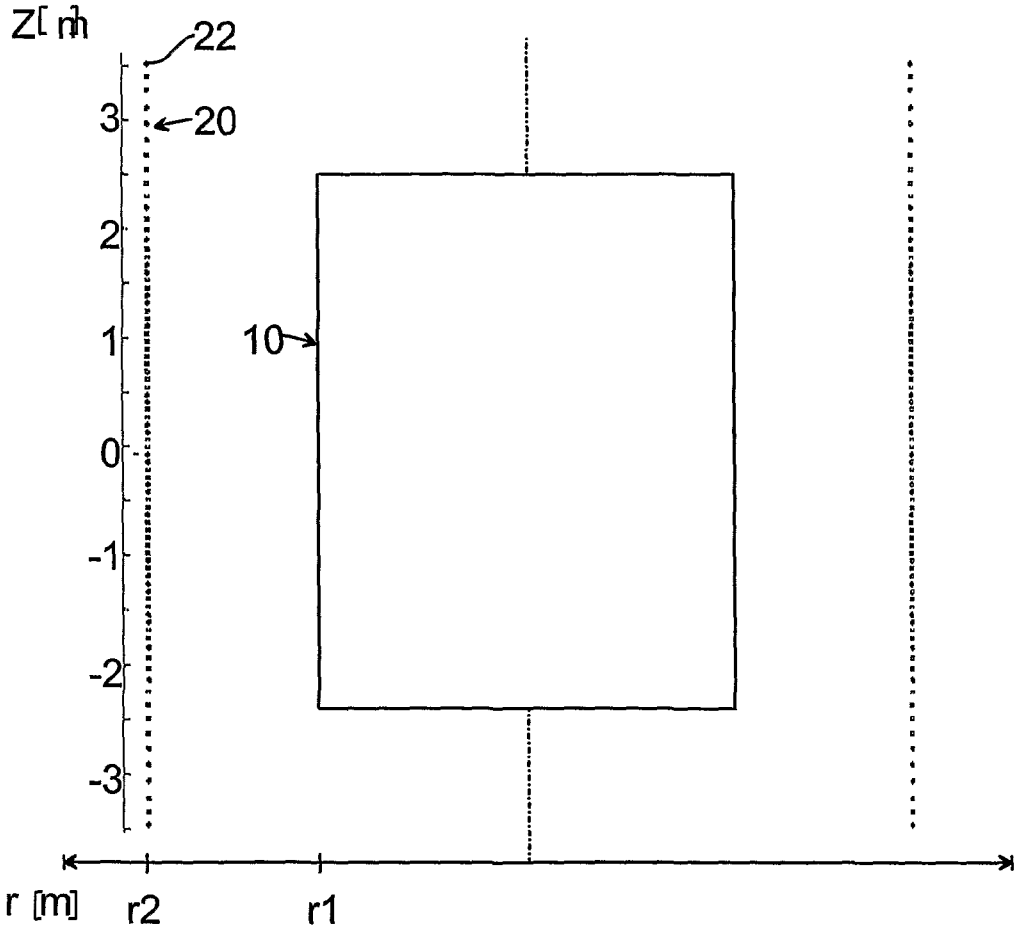
FIG. 7 is a side view showing the distribution of wire loops comprised in a reactor according to the invention.

In this preferred embodiment, the reactor shield comprises 80 short-circuited loops of stranded aluminium wire, half of which are visible in FIG. 7. The reactor shield radius $r_2$ is 3 meters and the height of the shield is 7 meters. The conductor diameter is about 30 millimeters. The axial distribution of the wire loops is given in table 1 below.

TABLE 1

| N = Loop number from midplane (Z = 0) | Distance from previous loop [mm] | Z [mm] |
|---|---|---|
| 1 | | 35 |
| 2-24 | 70 | |
| 25 | 70 | 1715 |
| 26-37 | 70 + (N − 25) * 7 | |
| 38 | 70 + (38 − 25) * 7 = 161 | 3262 |
| 39 | 120 | 3382 |
| 40 | 120 | 3502 |

Figure 8:
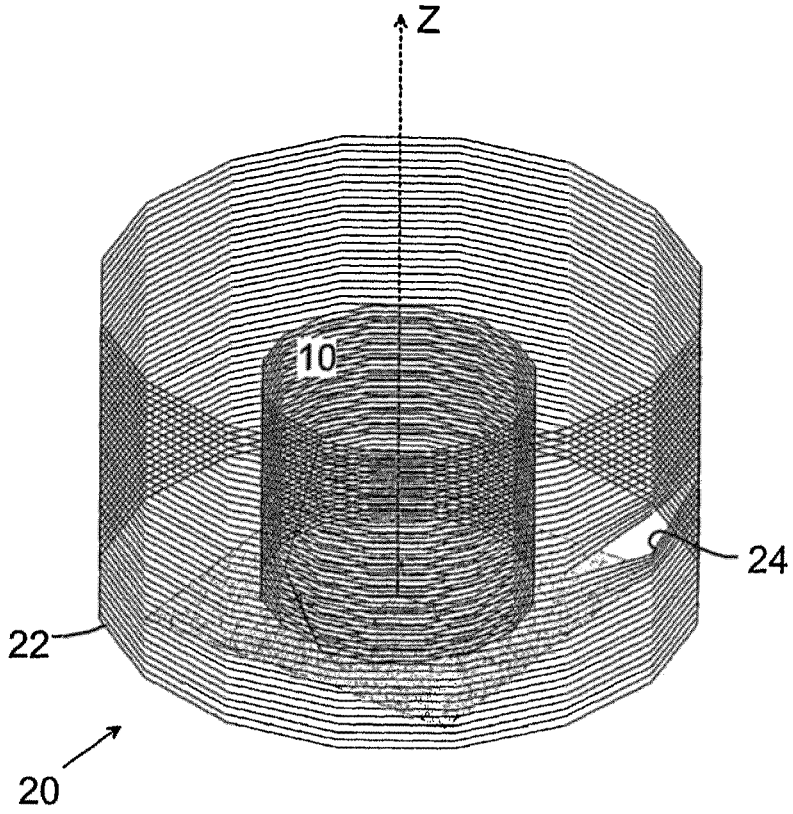
FIG. 8 is a view similar to the one shown in FIG. 1 with an opening provided in the reactor shield.
Figure 9:
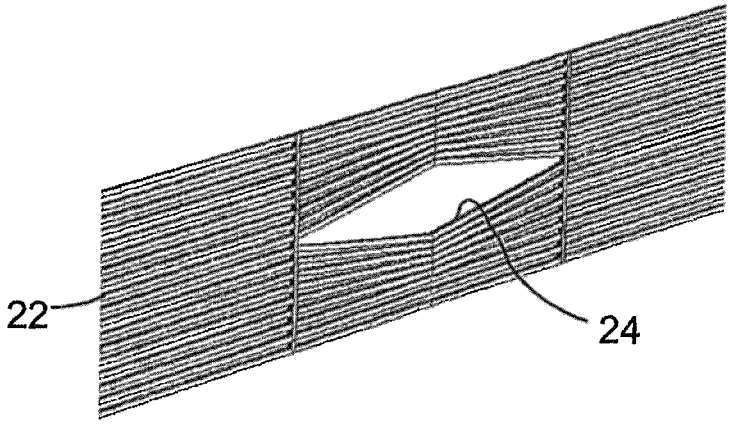
FIG. 9 is a detailed view of the opening shown in FIG. 6.

This design is both economical and flexible, and can easily be upgraded to higher reactor currents if necessary. An opening 24 for a bushing can easily be formed in the shield 20 by supports holding the wires apart, as is shown in FIGS. 8 and 9. It is preferred that the wires and the supports around the opening be insulated from each other except for necessary grounding unless measurements have confirmed that insulation is not necessary.

Alternatively, the wires close to the opening are provided with increased material area in order to cope with the higher currents induced close to the opening.

An opening of constant height, enough for the bushing, and stretching around the shield has been simulated. The dissipation ($W/m^3$) in the wires in this case in each wire closest to the opening has increased from about 500 W to 1500 W, i.e., a 70% current increase, but only a small part of this would affect the bushing. In addition, the dissipation in the adjacent wires has decreased, giving only a 1.5 kW total increase for the shield. Even this uneconomical design could easily be handled, and in a real design the wires will form an opening only between two of the eight vertical supports, giving much smaller increase in dissipation.

A preferred embodiment of a reactor shield according to the invention has been described. A person skilled in the art realizes that this could be varied within the scope of the appended claims.

The inventive shield has been described as a shield for a reactor. In this context the term reactor should be interpreted broadly, covering any inductance or similar device emitting electromagnetic radiation.

The invention claimed is:

1. A reactor shield, comprising:

an electrically conductive material arranged to be provided around a power transmission system reactor, wherein the electrically conductive material comprises a plurality of closed loops of electrically conductive wires, each wire being joined together at ends of the wire, wherein the closed loops of electrically conductive wires are arranged in mutually parallel horizontal planes, wherein a distribution of the closed loops is mirrored about a symmetry plane, wherein the distribution of the closed loops is denser close to the symmetry plane, and wherein the density of the distribution of the closed loops is correlated to a density of a magnetic field generated by the power transmission system reactor.

2. The reactor shield according to claim 1, further comprising:

an opening in the shield configured to receive a bushing.

3. The reactor shield according to claim 2, wherein the wires close to the opening are provided with increased material area.

4. The reactor shield according to claim 1, further comprising:

an electrically conductive plate arranged inside the closed loops.

5. The reactor shield according to claim 1, wherein the wires comprises twisted stranded wires.

6. A method of providing a reactor shield around a power transmission system reactor, the method comprising:

providing an essentially circular frame, providing a plurality of closed circular loops of electrically conductive wires, and attaching the closed circular loops to the frame in mutually parallel horizontal planes in a distribution mirror about a symmetry plane and having a density greater closer to the symmetry plane, wherein the density of the distribution of the closed loops is correlated to a density of a magnetic field generated by the power transmission system reactor.

7. The method according to claim 6, wherein providing a plurality of closed circular loops of electrically conductive wires comprises joining together ends of a wire with a jointing sleeve.

* * * * *